US006629900B2

(12) United States Patent
Wu

(10) Patent No.: US 6,629,900 B2
(45) Date of Patent: Oct. 7, 2003

(54) COLLAPSIBLE GOAL FRAME FOR BALL GAMES

(76) Inventor: Jen-Chieh Wu, No. 24-2, Lane 65, Sanjiun St., Shulin City, Taipei Hsien (TW)

( * ) Notice: Subject to any disclaimer, the term of this patent is extended or adjusted under 35 U.S.C. 154(b) by 0 days.

(21) Appl. No.: 10/085,039

(22) Filed: Mar. 1, 2002

(65) Prior Publication Data

US 2003/0166424 A1 Sep. 4, 2003

(51) Int. Cl.[7] ..... A63B 63/00

(52) U.S. Cl. ..... 473/478; 473/476; 473/415; 273/407; 403/102

(58) Field of Search ..... 473/476, 478, 473/415, 490–495, 477; 273/407, 400; 403/102; 43/12; 16/331

(56) References Cited

U.S. PATENT DOCUMENTS 1,039,986 A * 10/1912 Merritt ..... 403/61
4,437,480 A * 3/1984 Husa ..... 135/74
4,611,945 A * 9/1986 Diego ..... 403/61
5,178,583 A * 1/1993 Rankin ..... 464/114
5,431,411 A * 7/1995 Padilla ..... 473/416
5,539,957 A * 7/1996 Schmidt ..... 16/331
5,746,533 A * 5/1998 Schmidt ..... 403/102
6,241,630 B1 * 6/2001 Alberti ..... 473/492
6,402,643 B1 * 6/2002 Gill ..... 473/478
6,558,279 B1 * 5/2003 Goldwitz ..... 473/478

* cited by examiner

*Primary Examiner*—Paul T. Sewell
*Assistant Examiner*—M. Chambers
(74) *Attorney, Agent, or Firm*—Birch, Stewart, Kolasch & Birch, LLP

(57) ABSTRACT

A collapsible goal frame for ball games has a frame composed by a vertical n-shaped frame, an upper horizontal n-shaped frame, a lower horizontal n-shaped frame and two vertical supporting poles; in particular, connecting tubes are contraposed between the upper horizontal n-shaped frame and the lower horizontal n-shaped frame; the present invention is characterized that two sides of the vertical n-shaped frame are respectively disposed with a 180° bendable joint; on two sides of the upper horizontal n-shaped frame and the lower horizontal n-shaped frame are respectively disposed with a 90° bendable joint; after the supporting pole is detached, the bendable joints of the upper horizontal n-shaped frame and the lower horizontal n-shaped frame are folded toward each other; then the bendable joints on two sides at the center of the vertical n-shaped frame are bent forwardly and downwardly to form a collapsed structure slightly in a W-shape.

11 Claims, 11 Drawing Sheets

COLLAPSIBLE GOAL FRAME FOR BALL GAMES

BACKGROUND OF THE INVENTION

1. Field of the Invention

The present invention provides a collapsible goal frame for ball games, more especially to a fin-oriented playing equipment for children, such as a goal frame structure for hockey or soccer games; the design thereof is particularly to adapt special joints for advantages of facilitating the folding and storing thereby to completely replace the conventional method of using screws to disassemble; furthermore, the feature of the storable structure is that, with a special design, the net doesn't have to be dismounted for folding.

2. Description of the Prior Art

Accordingly, in any ball games, such as hockey or soccer, there is a rule of hitting or kicking a ball into a transverse goal frame for scoring; that kind of activity requires the player to use energy to fully achieve the purpose of exercise. However, the present invention relates to a goal frame of smaller size, more especially, a device to be used by children for playing; therefore, the goal frame is preferred to be a collapsible structure; otherwise, it occupies considerable space for storage.

Most of the conventionally structural designs are assembled by a plurality of cross pole members, upright pole members and 90° bendable tube joints; the connecting method thereof forcefully telescopes all cross or upright pole members together at two ends of the bendable tube joints to be fixedly fastened by screws for erecting a goal frame, however, those pole members are assembled by screwing for playing the game and disassembled after the game; the procedure required is very troublesome and the screws required are too many to be collected or kept to avoid the situation of not having enough parts; if those screws are not tightly fastened, the stability of the goal won't be good enough to avoid danger; therefore, the assembly of the conventional structure not only requires many members, more time for assembly, but also is subjected to loss; that is the main shortcomings thereof. There is unitarily soldered goal frame with excessive volume, but that also requires considerable space for storage.

SUMMARY OF THE INVENTION

Therefore, the primary objective of the present invention is to design a goal frame to be easily collapsed by respectively folding an upper and a lower ends thereof and bending the front portion 180° forwardly to make the entire frame a folded structure slightly in a W-shape without dismounting the net or unscrewing the screw for facilitating application.

To enable a further understanding of the structural features and the technical contents of the present invention, the brief description of the drawings below is followed by the detailed description of the preferred embodiment.

DETAILED DESCRIPTION OF THE PREFERRED EMBODIMENTS

Figure 1:
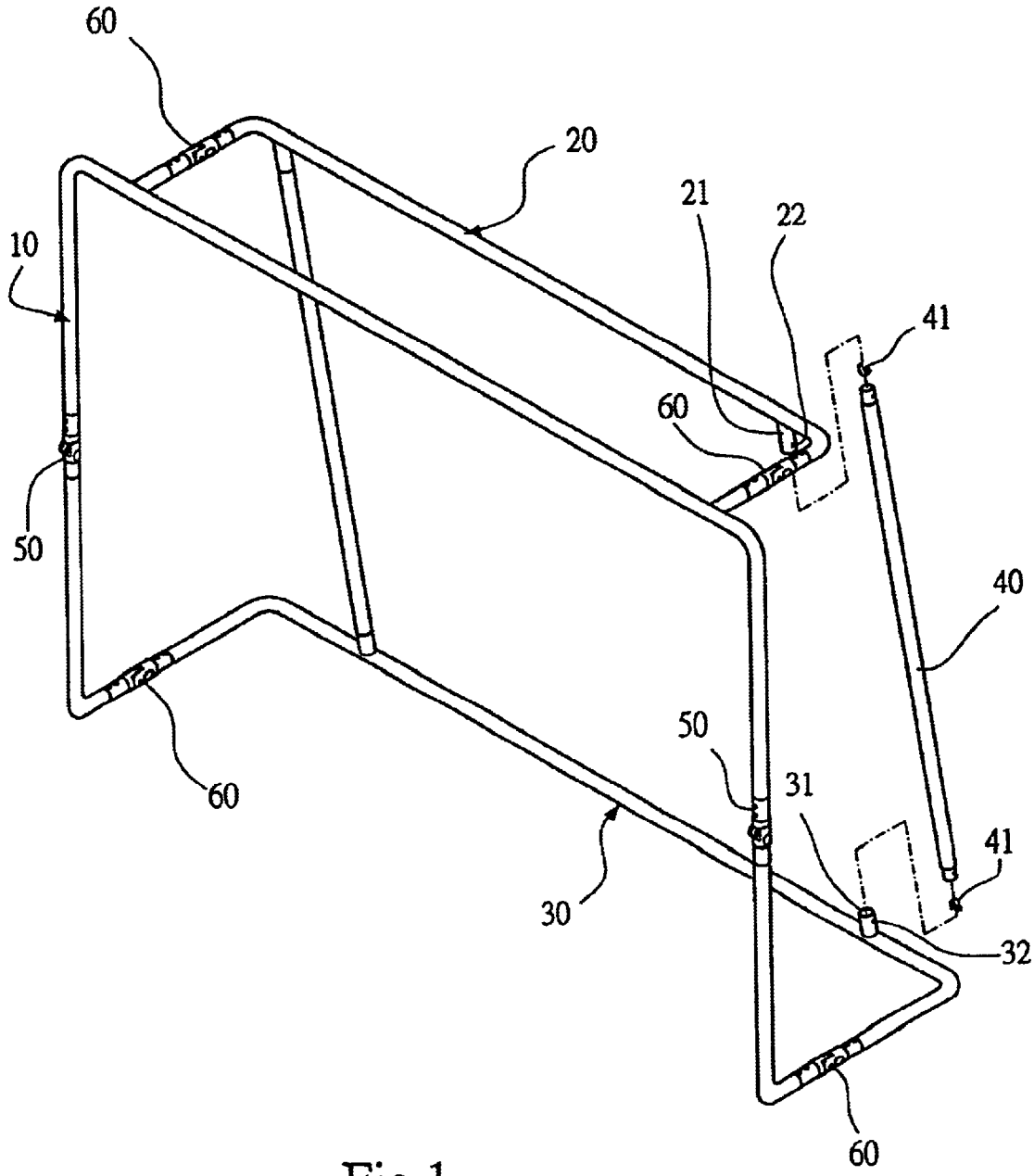
FIG. 1 is an exploded drawing of a partial structure of the present invention.
Figure 14:
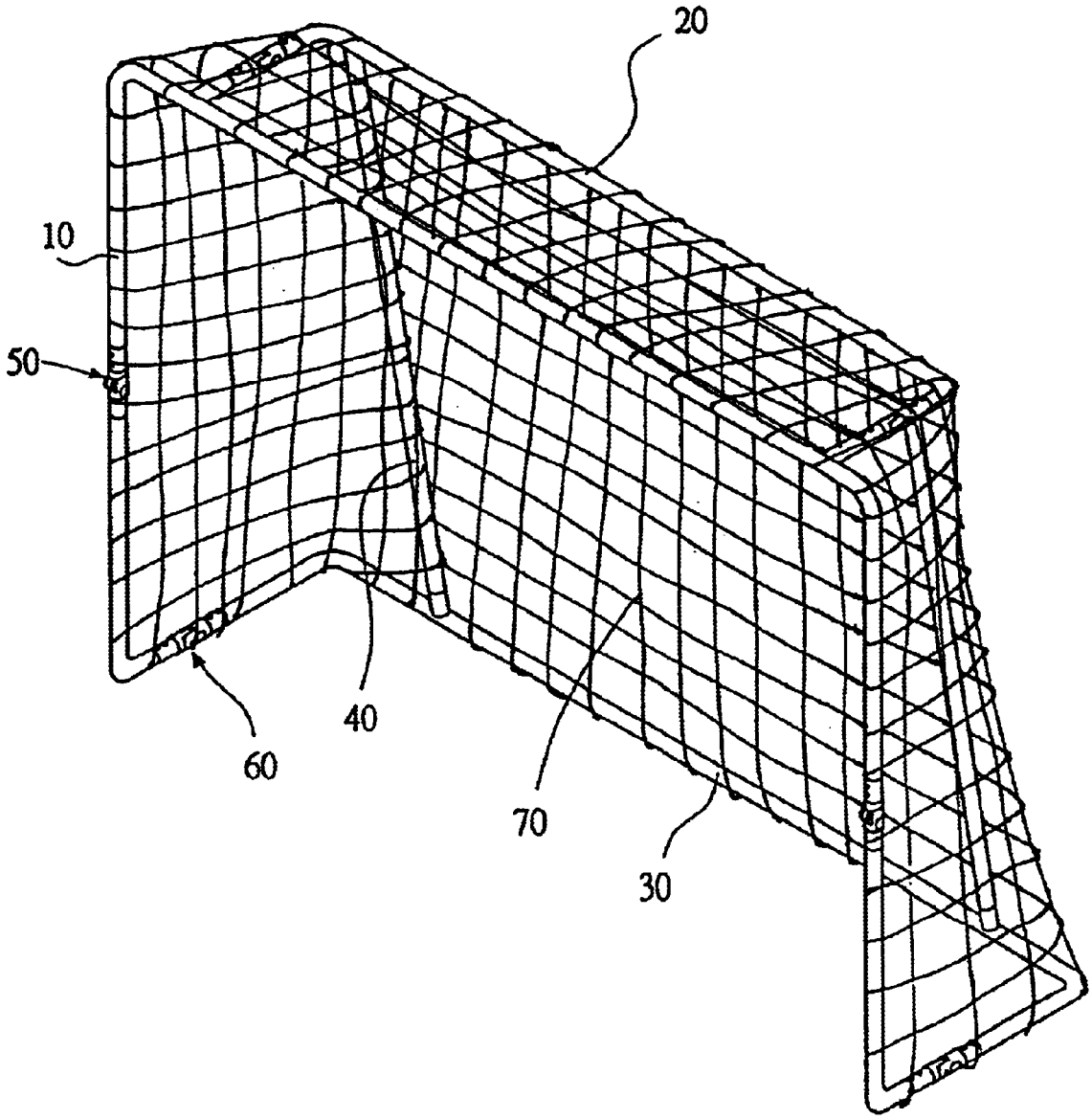
FIG. 14 is a drawing of an exemplary embodiment of the present invention disposed with a net hung thereon.

Referring to FIGS. 1 and 14, a goal frame of the present invention is a small-sized goal frame provided exclusively for children to play with and mainly has a net (70) hung on the frame; the frame mainly comprises of a vertical n-shaped frame (10), an upper horizontal n-shaped frame (20), a lower horizontal n-shaped frame (30) and two vertical supporting poles (40); more especially, two opposite connecting tubes (21, 31) are disposed between the upper horizontal n-shaped frame (20) and the lower horizontal n-shaped frame (30); the end portion of the supporting pole (40) inserts inbetween for fastening; retaining holes (22, 32) are respectively disposed on the said two connecting tubes (21, 31); resilient retainers (41) are disposed at to end portions of the supporting poles (40) for retaining the supporting poles (40) to retaining holes (22, 32) of all connecting tubes (21, 31) so as to make the frame body more stable.

Figure 4:
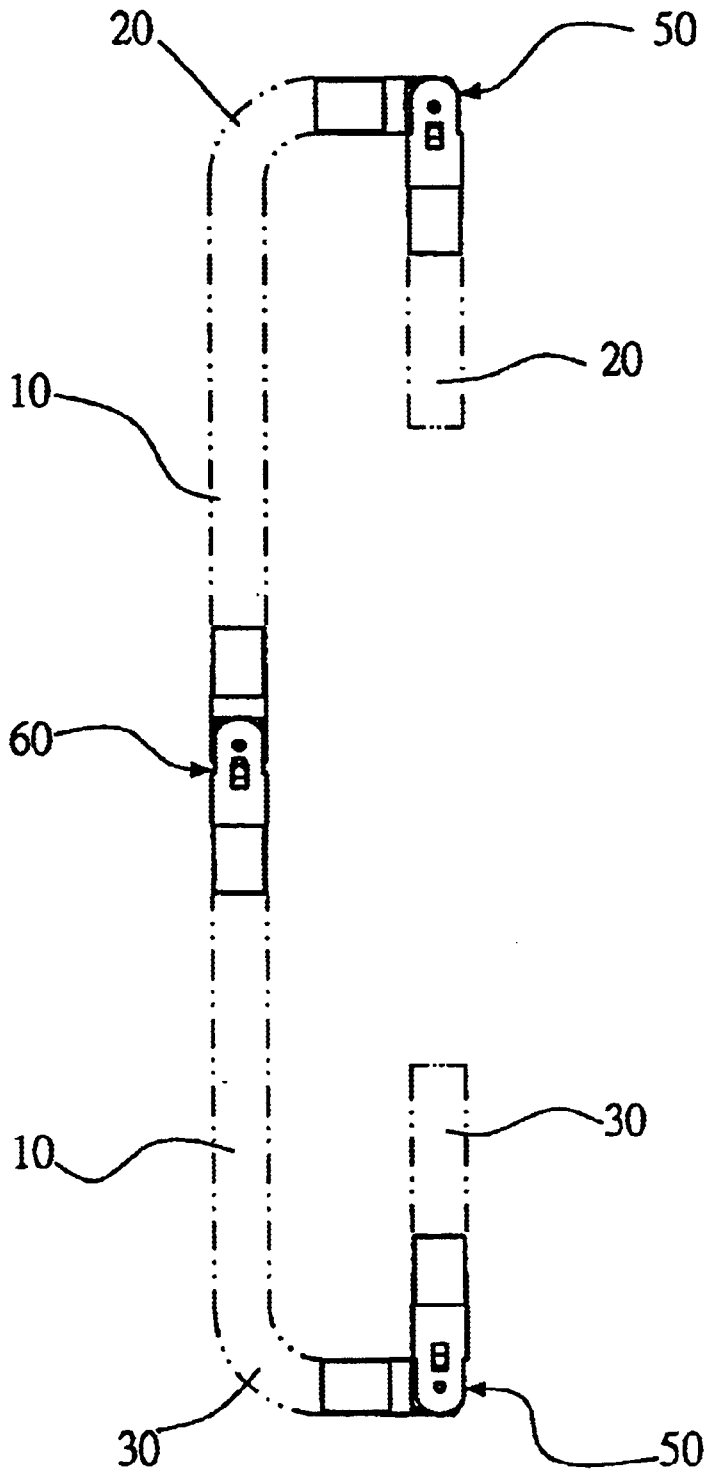
FIG. 4 is the first drawing of the folding movement of the present invention.
Figure 5:
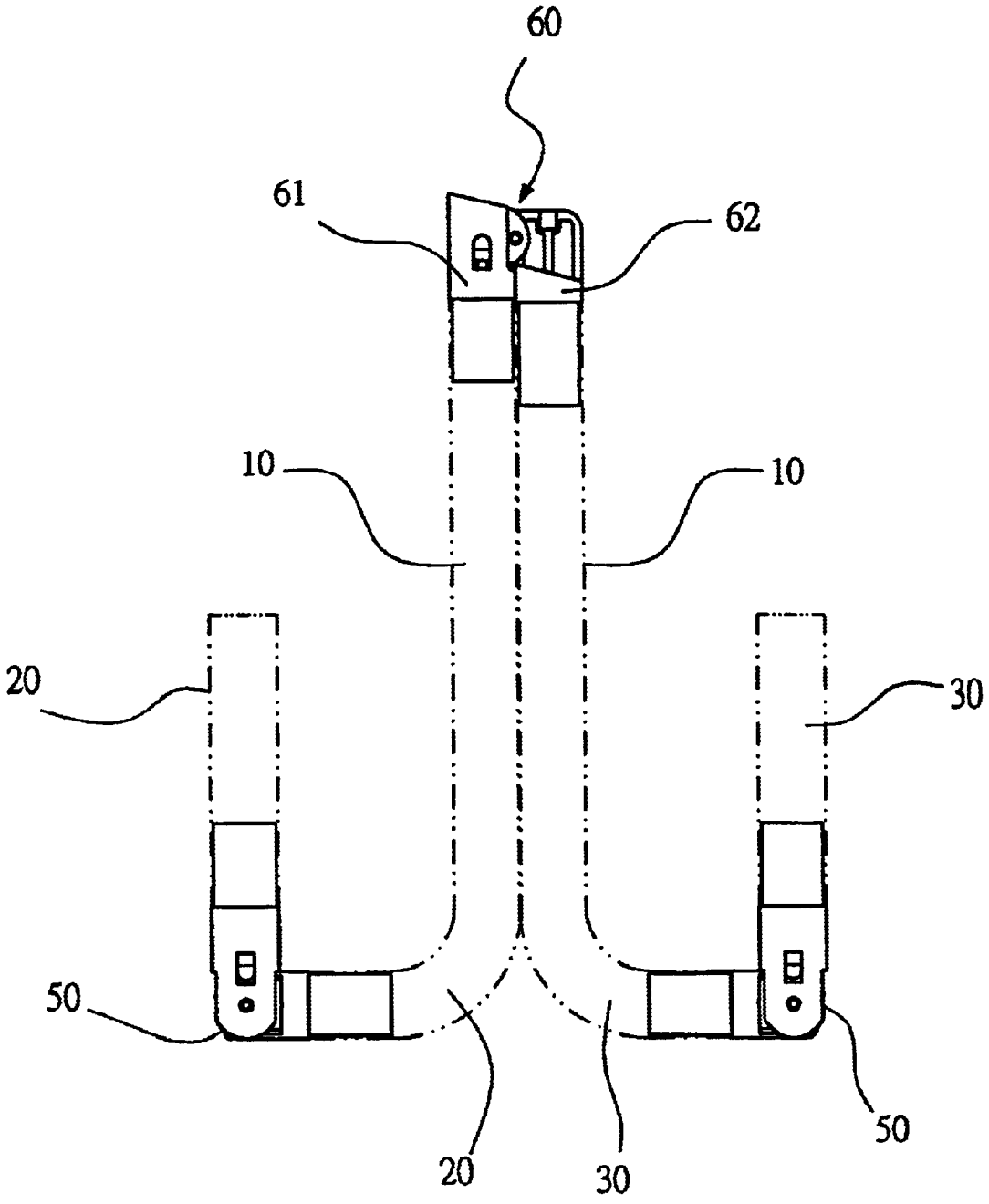
FIG. 5 is the second drawing of the folding movement of the present invention.

Referring to FIGS. 1, 4 and 5, the present invention mainly has a 180° bendable joint (60) disposed respectively on two sides of the vertical n-shaped frame (10); furthermore, a 90° bendable joint (50) is disposed respectively on two sides of the upper horizontal n-shaped frame (20) and the lower horizontal n-shaped frame (30); after the supporting pole (40) on the frame is disassembled, the upper horizontal n-shaped frame (20) and the lower horizontal n-shaped frame (30) are bent and folded toward each other by the said bendable joint (50), as shown in FIG. 4; then, as indicated in FIG. 5, the bendable joint (60) disposed on two sides at the center of the vertical n-shaped frame (10) is bent and folded forwardly and downwardly to make the vertical n-shaped frame (10), the upper horizontal n-shaped frame (20) and the lower horizontal n-shaped frame (30) fold into an approximate W-shaped structure without dismounting the net (70) nor requiring considerable storage space.

Actually, the 180° bendable joint (60) of the vertical n-shaped frame (10) can be replaced by the two consecutive 90° bendable joints (50) disposed on the upper horizontal n-shaped frame (20) and the lower horizontal n-shaped frame (30); furthermore, the bendable joints (50) on the upper horizontal n-shaped frame (20) and the lower horizontal n-shaped frame (30) can be replaced by the 180° bendable joint (60) disposed respectively on the vertical n-shaped frame (10).

Figure 2:
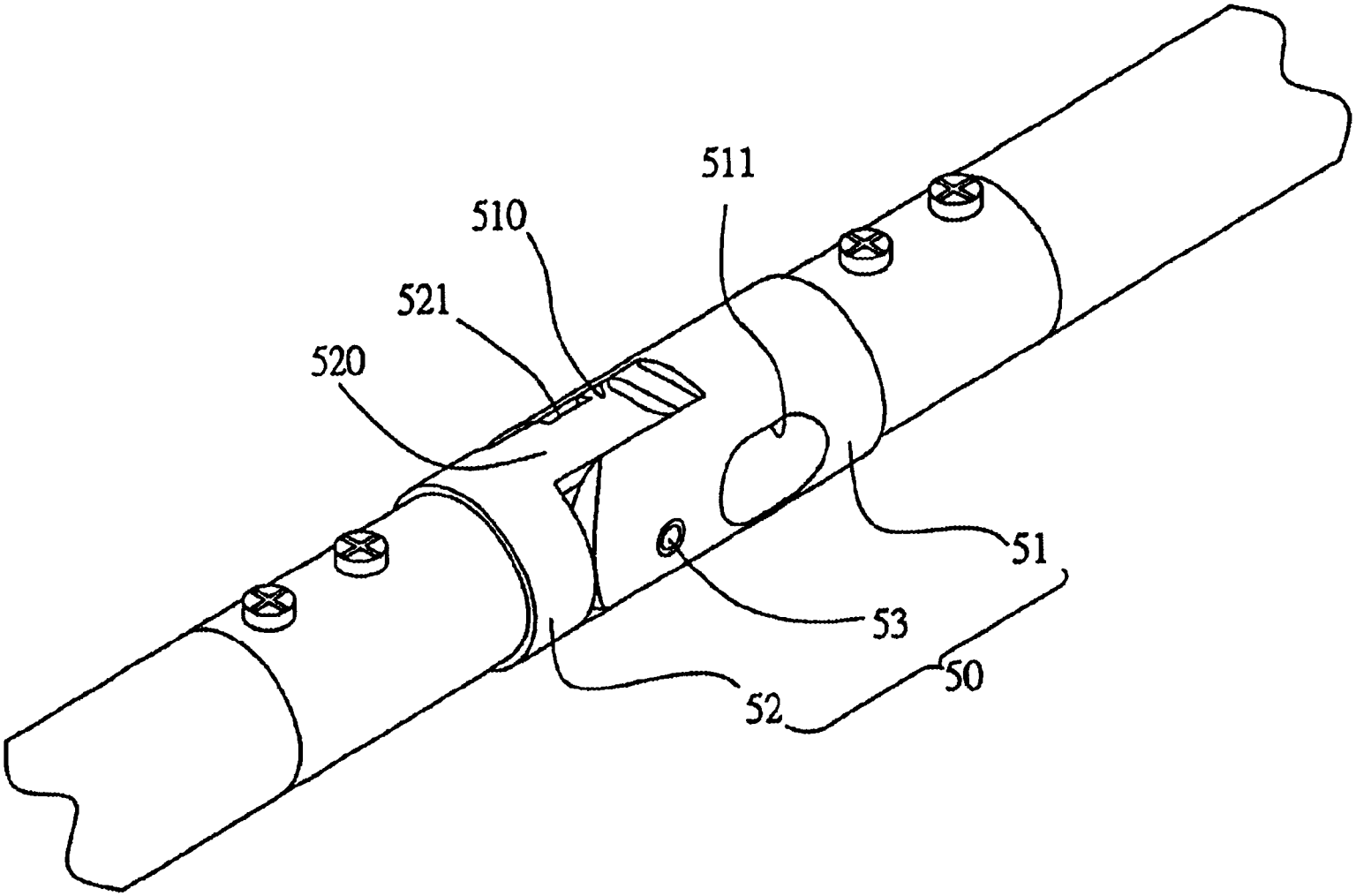
FIG. 2 is an external view drawing of the assembly of a 90° bendable joint of the present invention.
Figure 6:
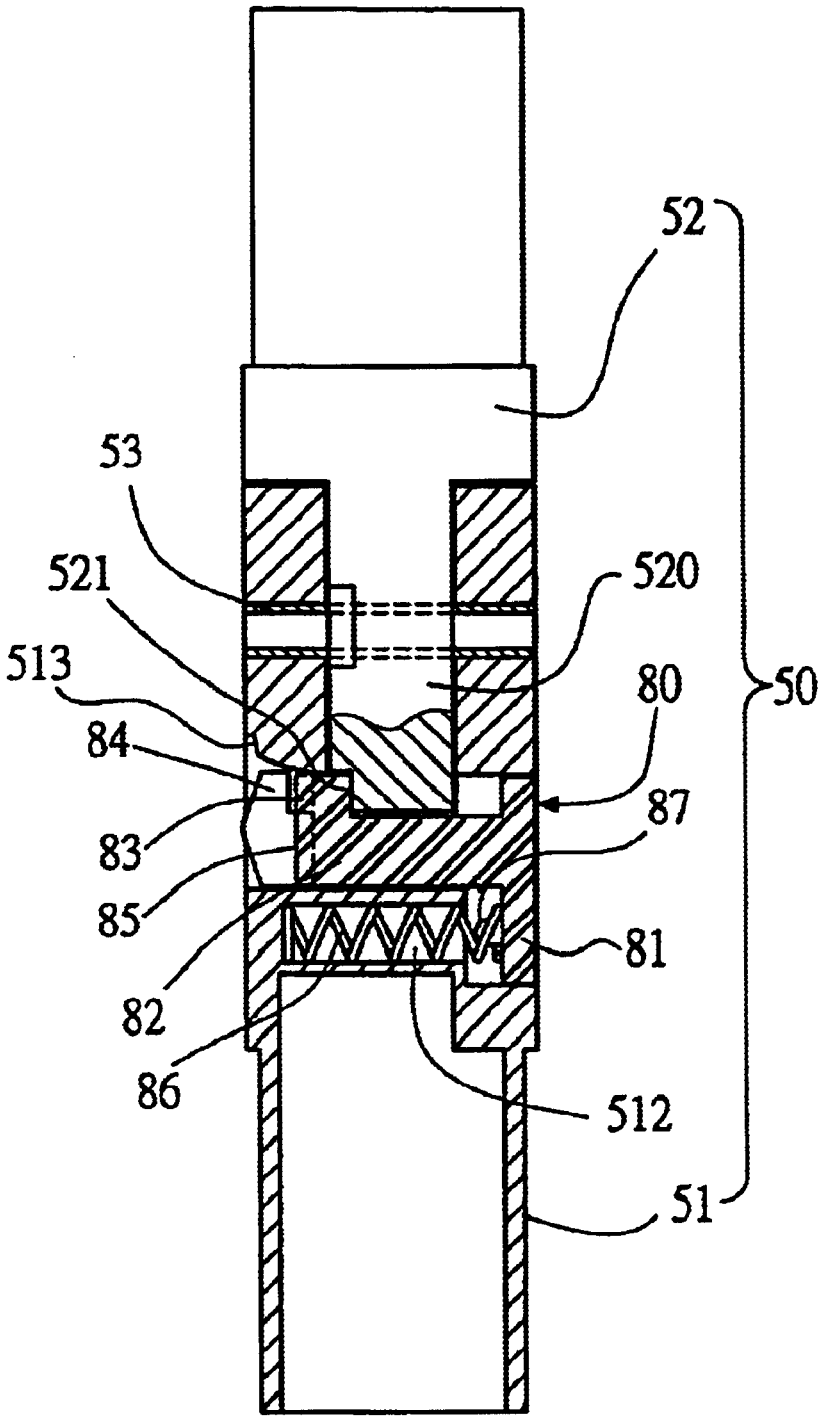
FIG. 6 is a cross-sectional drawing of the retaining structure of the 90° bendable joint and the 180° bendable joint of the present invention.
Figure 7:
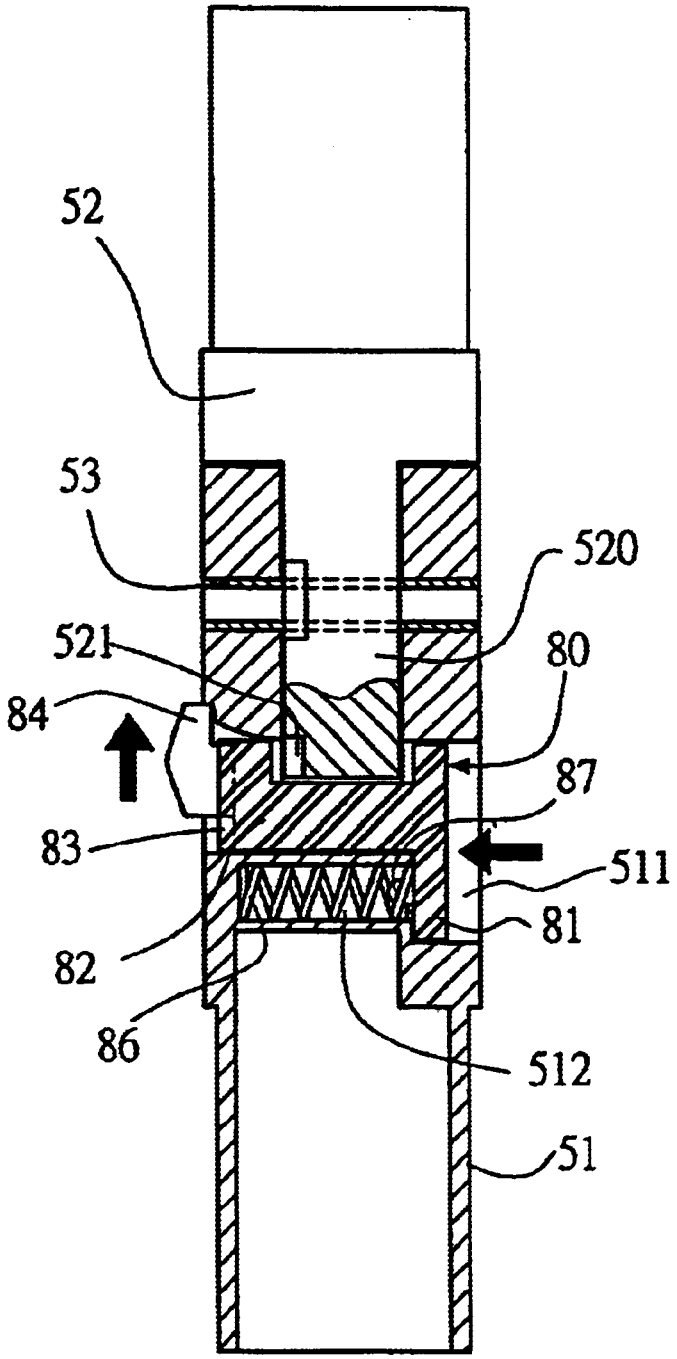
FIG. 7 is a drawing of the movement of the retaining structure of the 90° bendable joint and the 180° bendable joint of the present invention.
Figure 8:
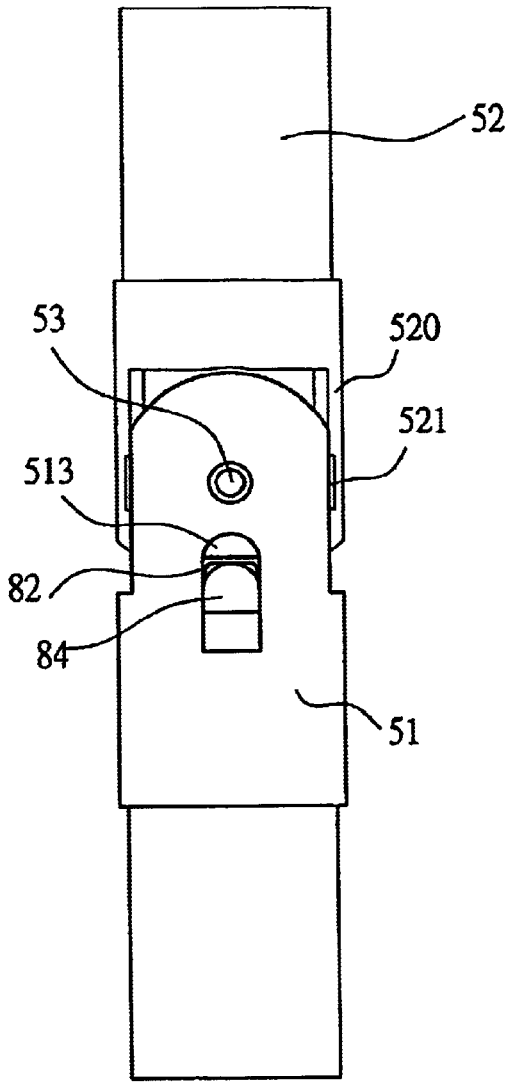
FIG. 8 is an external view drawing of the assembly of a 90° bendable joint of the present invention viewed from another angle.
Figure 9:
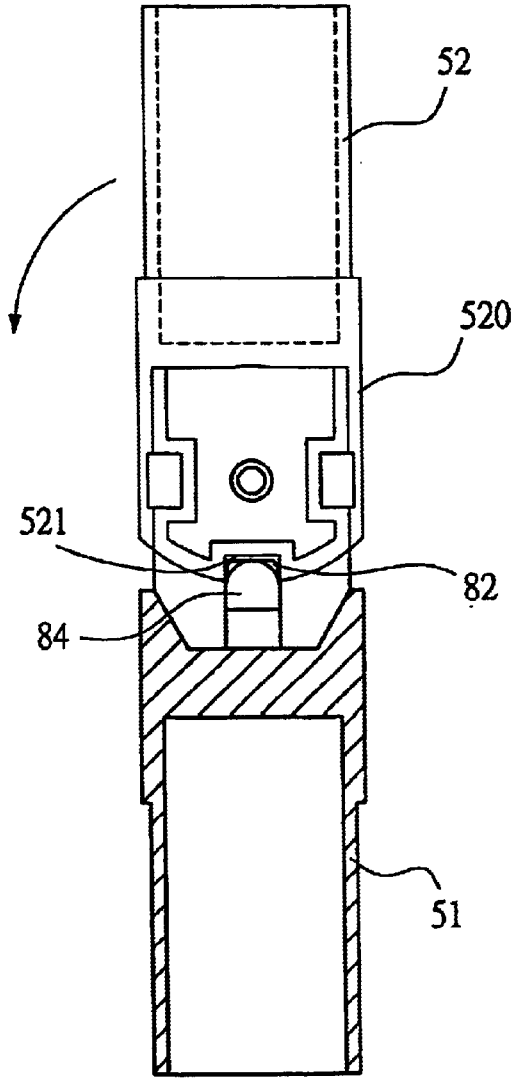
FIG. 9 is a cross-sectional drawing of the partial structure in FIG. 8.
Figure 10:
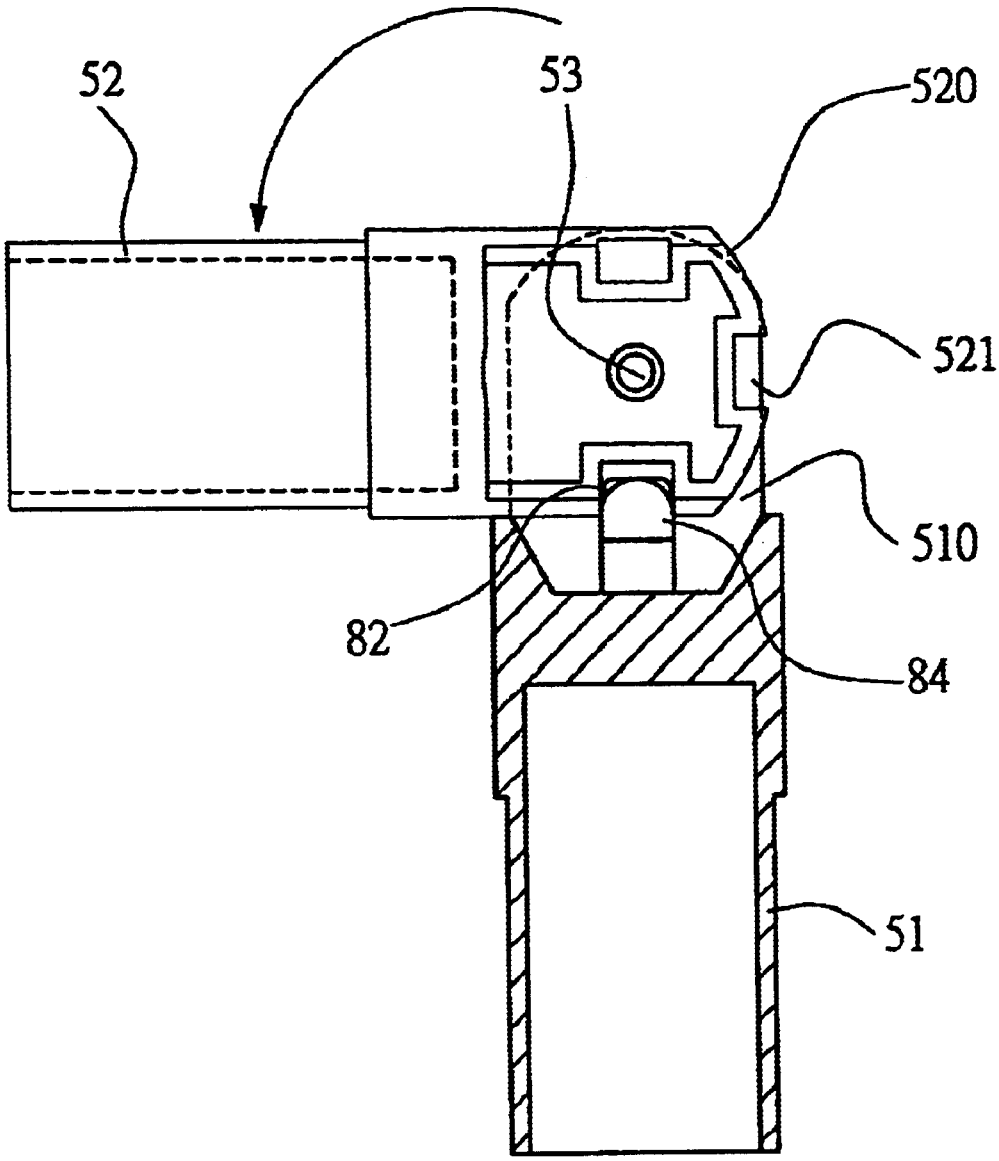
FIG. 10 is a drawing of an exemplary embodiment of the 90° bendable joint of the present invention.

Referring to FIGS. 2, 6 and 7, the exemplary embodiment of the bendable joint (50) capable of bending 90° mainly comprises two ends heads (51, 52) and each one end thereof is in tubular shape to be connected with the frame; wherein, the other end of one end head (51) is disposed with a forked recess (510); a through button hole (511) is disposed across the recess (510) at 90° and approximately at the central position of the said end head (51); the said button hole (511) is slightly formed as an inverse L-shaped structure with a larger aperture; a blind hole (512) is also recessed deeply at the same area with a spring (86) disposed therein, the side with smaller aperture of the button hole (511) extends to form a shallower positioning slot (513); a T-shaped press button (81) extends into the button hole (511) and the press end thereof is fitly received at the end portion of the button hole (511); the inner side of the distal end of the press button (81) presses against one end of the spring (86); more especially, a guide post (87) is disposed at that area to make the positioning between the springs (86) more specific; the other end of the press button (81) is disposed with an extending block (82) with the distal end thereof disposed with a movable sliding retainer (84); the said sliding retainer (84), the extending block (82) and the convex tenon (520) are jointed by a dovetail slot (85) and a dovetail seat (83); referring to FIGS. 2 and 9, the other end of the other end head (52) is disposed with a convex tenon (520) with at least one retaining slot (521) disposed at a proper position; the said convex tenon (520) extends into the recess (510) to pivotally connect these two end heads (51, 52) by means of a pivot shaft (53) and to make the extending block (82) of a press-retaining unit (80) retain and stop in one of the retaining slots (521), as shown in FIGS. 6 and 9; when the press button (81) is depressed downwardly, as shown in FIGS. 6 and 7, the extending block (82) detaches from the retaining slot (521) to make one end head (52) in the state indicated in FIG. 9 rotate to a state of 90° indicated in FIG. 10; releasing the press button (81), as shown in FIG. 6, makes the extending block (82) retain into another retaining slot (521); furthermore, as shown in FIG. 7, if the press button (81) is depressed and the sliding retainer (84) is pushed forwardly to make one end thereof retain against to the area of the positioning slot (513), then enough time is provided for releasing the end head (52) with the convex tenon (520) into a state of completely pivotal connection without any limitation.

Figure 3:
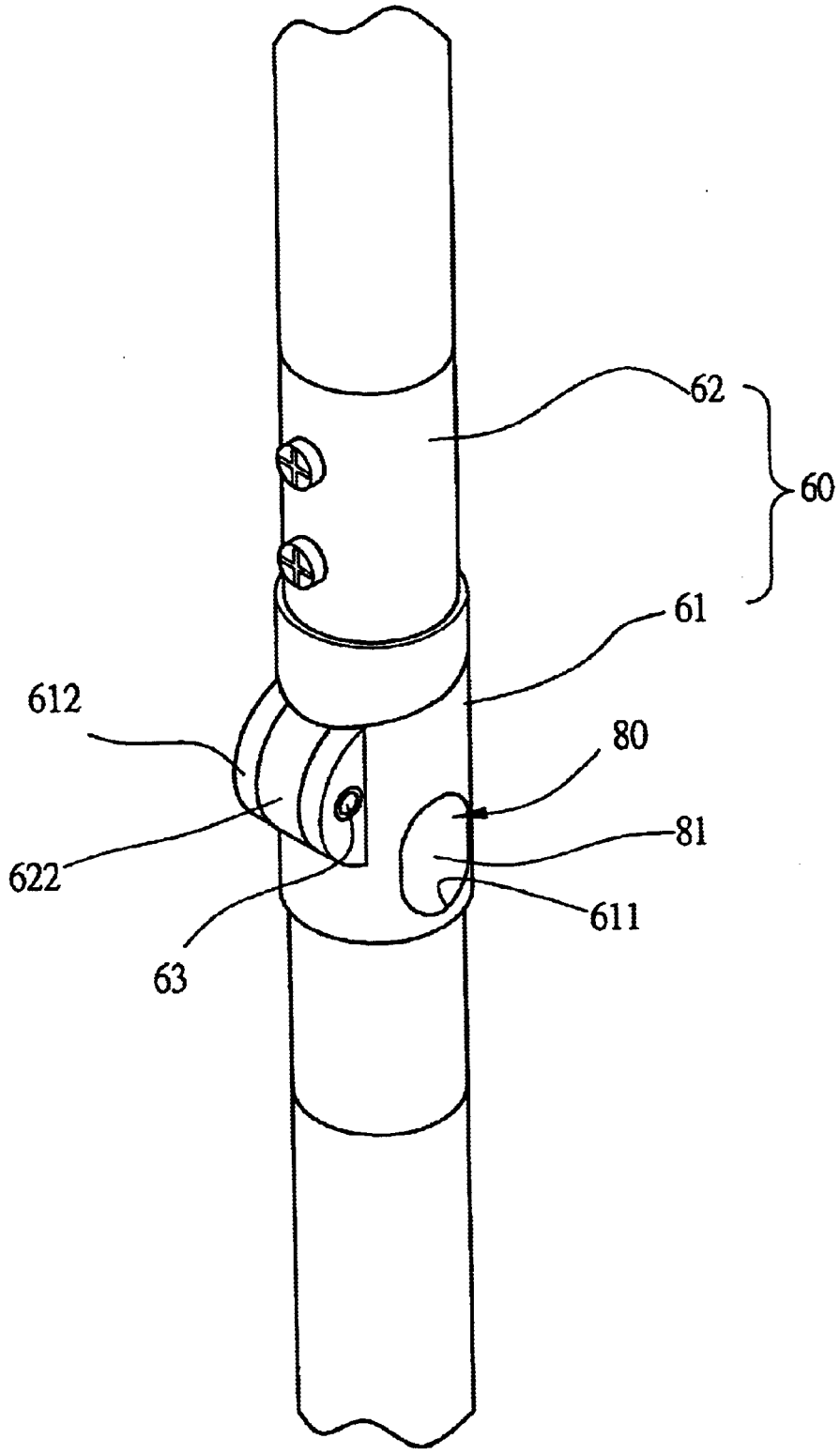
FIG. 3 is an external view drawing of the assembly of a 180° bendable joint of the present invention.
Figure 11:
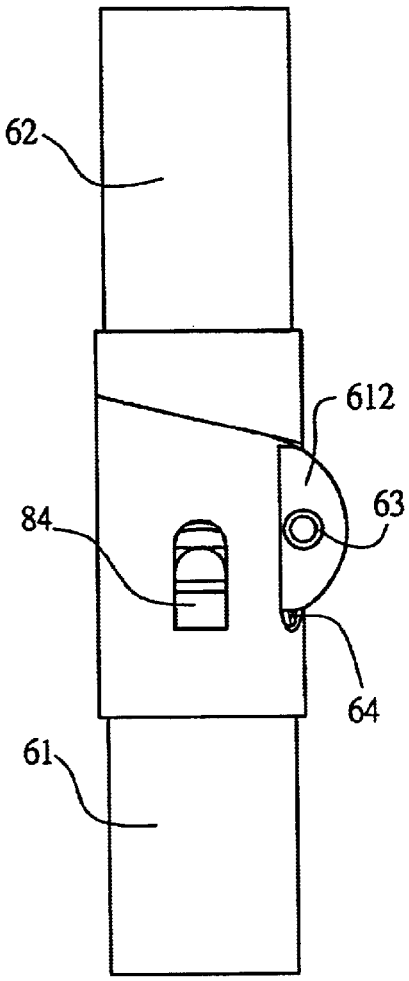
FIG. 11 is an external view drawing of the assembly of a 180° bendable joint of the present invention viewed from another angle.
Figure 13:
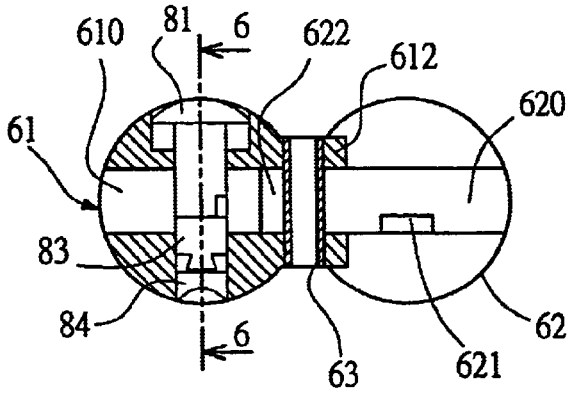
FIG. 13 is a bird's-eye view and partially cross-sectional drawing of FIG. 12.
Figure 12:
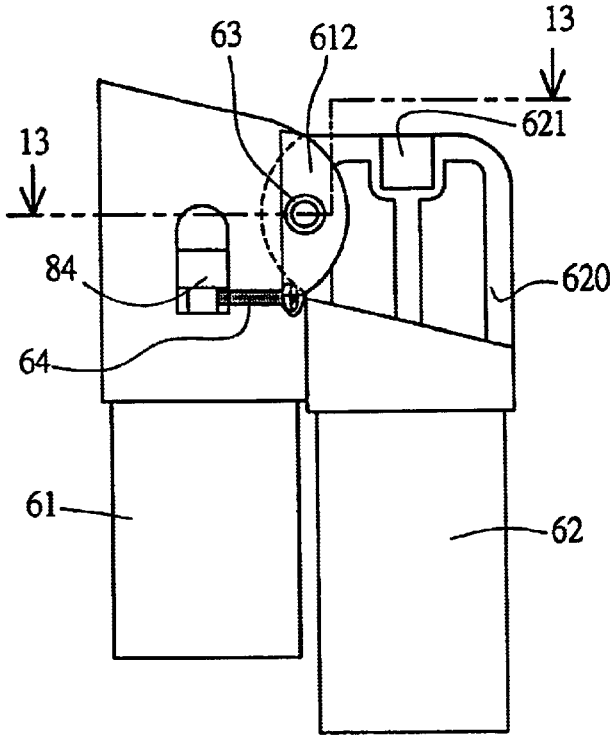
FIG. 12 is a drawing of an exemplary embodiment of the 180° bendable joint of the present invention.

Referring to FIGS. 3, 11 and 12, the exemplary embodiment of the 180° bendable joint (60) comprises of two end heads (61, 62) and each one end thereof is in tubular shape to be connected with the frame; wherein, the other end of one end head (61) is disposed with a forked recess (610); a through button hole (611) disposed across the recess (610) at 90° and approximately at the central position of the said end head (61); the internal structure of the said button hole (611) is exactly the same as that of the 90° bendable joint (50) as shown in FIG. 6 and also disposed with a press-retaining unit (80) (the structure thereof has been described before); additionally, a pin (64) inserts through one side of an end head (61) and presses into the groove of the lateral side of the press button (81) to prevent it from derailing; two opposite ears (612) are disposed at two ends on one side of the recess (610); another end of the other end head (62) is disposed with a plurality of convex tenons (620) of retaining slots (621); one side of the said convex tenon (620) is disposed with a lateral ear (622) located between two convex ears (612) and penetrated by a pivotal shaft (63); referring to FIGS. 3, 12 and 13, exerting force to the press button (81) detaches the extending block (82) from the retaining slot (621) to make two end heads (61, 62), based on the pivotal shaft as the central point, fold toward each other, as shown in FIG. 12, for facilitating the application.

The present invention is specially designed to be folded without dismounting the net from the frame by the cooperation between the bendable joints and without disassembling screws; the operating procedure of the present invention is smooth. It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A collapsible goal frame for ball games mainly has a net hung on the frame, the frame mainly comprises of a vertical n-shaped frame, an upper horizontal n-shaped frame, a lower horizontal n-shaped frame and two vertical supporting poles; more especially, two opposite connecting tubes are disposed between the upper horizontal n-shaped frame and the lower horizontal n-shaped frame; the end portion of the supporting poles inserts inbetween for fastening; the present invention is characterized that:

a 180° bendable joint is disposed respectively on two sides of the vertical n-shaped frame; a 90° bendable joint is disposed respectively on two sides of the upper horizontal n-shaped frame and the lower horizontal n-shaped frame; after the supporting pole on the frame is disassembled, the upper horizontal n-shaped frame and the lower horizontal n-shaped frame are bent and folded toward each other by the said bendable joint; then, the bendable joint disposed on two sides at the center of the vertical n-shaped frame is bent and folded forwardly and downwardly to make the vertical n-shaped frame, the upper horizontal n-shaped frame and the lower horizontal n-shaped frame fold into an approximate W-shaped structure without dismounting the net nor requiring considerable storage space.

2. A collapsible goal frame for ball games according to claim 1, wherein the 180° bendable joint of the vertical n-shaped frame can be replaced by two consecutive 90° bendable joints, the bendable joints on the upper horizontal n-shaped frame and the lower horizontal n-shaped frame can be replaced by the 180° bendable joint disposed respectively on the vertical n-shaped frame.

3. A collapsible goal frame for ball games according to claim 1, wherein retaining holes are respectively disposed on the said two connecting tubes; resilient retainers are disposed at two end portions of the supporting pole for retaining the supporting poles to retaining holes of all connecting tubes so as to make the frame body more stable.

4. A collapsible goal frame for ball games according to claim 1, wherein the bendable joint capable of bending 90° mainly comprises two ends heads and each one end thereof is in tubular shape to be connected with the frame; wherein, the other end of one end head is disposed with a forked recess; a through button hole disposed across the recess at 90° and approximately at the central position of the said end head; the said button hole is slightly formed as an inverse L-shaped structure with a larger aperture; a blind hole is also recessed deeply at the same area with a spring disposed therein; a T-shaped press button extends into the button hole and the press end thereof is fitly received at the end portion of the button hole; the inner side of the distal end of the press button presses against one end of the spring; the other end of the press button is disposed with an extending block with the distal end thereof disposed with a movable sliding retainer; the other end of the other end head is disposed with a convex tenon with at least one retaining slot disposed at a proper position; the said convex tenon extends into the recess to pivotally connect these two end heads by means of a pivot shaft and to make the extending block of a press-retaining unit retain and stop in one of the retaining slots; when the press button is depressed downwardly, the extending block detaches from the retaining slot to make one end head rotate to 90°; on the contrary, releasing the press button makes the extending block retain into another retaining slot for positioning.

5. A collapsible goal frame for ball games according to claim 4, wherein the button hole on the side of smaller aperture extends to form a positioning slot; the press button is depressed to make the sliding retainer push forwardly to retain against to the area of the positioning slot for releasing the end head with the convex tenon into a state of completely pivotal connection.

6. A collapsible goal frame for ball games according to claim 4, wherein a guide post is disposed at that area where the inner side of the distal end of the press button presses against the spring to make the positioning between the springs more specific.

7. A collapsible goal frame for ball games according to claim 4, wherein the extending block at the distal end of the press button and sliding retainer are jointed by a dovetail slot and a dovetail seat.

8. A collapsible goal frame for ball games according to claim 1, wherein the 180° bendable joint comprises of two end heads and each one end thereof is in tubular shape to be connected with the frame; wherein, the other end of one end head is disposed with a forked recess; a through button hole is disposed across the recess at 90° and approximately at the central position of the said end head; the said button hole is slightly formed as an inverse L-shaped structure with a larger aperture; a blind hole is also recessed deeply at the same area with a spring disposed therein; a T-shaped press button extends into the button hole and the press end thereof is fitly received at the end portion of the button hole; the inner side of the distal end of the press button presses against one end of the spring; the other end of the press button is disposed with an extending block with the distal end thereof disposed with a movable sliding retainer; a pin inserts through one side of an end head and presses into the groove on the lateral side of the press button to prevent it from derailing; two opposite ears are disposed at two ends on one side of the recess;

another end of the other end head is disposed with a plurality of convex tenons of retaining slots; one side of the said convex tenon is disposed with a lateral ear located between two convex ears and penetrated by a pivotal shaft; exerting force to the press button detaches the extending block from the retaining slot to make two end heads fold toward each other based on the pivotal shaft as the central point.

9. A collapsible goal frame for ball games according to claim 8, wherein the button hole on the side of smaller aperture extends to form a positioning slot; the press button is depressed to make the sliding retainer push forwardly to retain against to the area of the positioning slot for releasing the end head with the convex tenon into a state of completely pivotal connection.

10. A collapsible goal frame for ball games according to claim 8, wherein a guide post is disposed at that area where the inner side of the distal end of the press button presses against the spring to make the positioning between the springs more specific.

11. A collapsible goal frame for ball games according to claim 8, wherein the extending block at the distal end of the press button and sliding retainer are jointed by a dovetail slot and a dovetail seat.

* * * * *